United States Patent [19]

Odawara

[11] 4,363,832

[45] Dec. 14, 1982

[54] METHOD FOR PROVIDING CERAMIC LINING TO A HOLLOW BODY BY THERMIT REACTION

[75] Inventor: Osamu Odawara, Sendai, Japan

[73] Assignee: Director-General of the Agency of Industrial Science & Technology, Tokyo, Japan

[21] Appl. No.: 204,583

[22] Filed: Nov. 6, 1980

[30] Foreign Application Priority Data

Jan. 16, 1980 [JP] Japan ..... 55-3414

[51] Int. Cl.[3] ..... B05D 7/22

[52] U.S. Cl. ..... 427/183; 264/60; 264/102; 264/311; 427/201; 427/229; 427/234; 427/241; 427/295; 427/405

[58] Field of Search ..... 264/60, 65, 311, 102; 427/183, 229, 234, 295

[56] References Cited

U.S. PATENT DOCUMENTS

| | | | |
|---|---|---|---|
| 3,551,188 | 12/1970 | Lindquist | 427/295 |
| 3,974,306 | 8/1976 | Inamura et al. | 427/234 |
| 4,048,352 | 9/1977 | Pignocco et al. | 427/234 |
| 4,117,868 | 10/1978 | Pignocco et al. | 138/146 |
| 4,142,556 | 3/1979 | Pignocco et al. | 138/146 |
| 4,150,182 | 4/1979 | Pignocco et al. | 428/36 |

*Primary Examiner*—James H. Derrington
*Attorney, Agent, or Firm*—Brisebois & Kruger

[57] ABSTRACT

The invention provides a novel method for forming a ceramic lining layer on the inward surface of a hollow body such as a pipe. According to the invention, a thermit mixture, for example, composed of aluminum powder and an iron oxide is placed in the hollow space of the hollow body, which is rotated at a high speed so as that the thermit mixture is pressed against the wall of the hollow body by the centrifugal force and the thermit mixture is ignited, for example, by contacting with an acetylene flame. The thermit reaction of the thermit mixture propagates under the influence of the centrifugal force so that the molten metal formed from the reducible metal oxide and the ceramic oxide formed from the strongly reductive element are separated into stratified layers by virtue of their density difference with the ceramic oxide forming the innermost layer and the metal forming the intermediate layer between the ceramic oxide layer and the wall of the hollow body with strong bonding of the ceramic oxide layer upon solidification by cooling.

10 Claims, 2 Drawing Figures

METHOD FOR PROVIDING CERAMIC LINING TO A HOLLOW BODY BY THERMIT REACTION

BACKGROUND OF THE INVENTION

The present invention relates to a method for providing a lining of a ceramic material to a hollow body by means of a thermit reaction or, more particularly, to a method for providing a ceramic lining to a hollow body by means of a thermit reaction taking place under the influence of a centrifugal force.

The invention also relates to a metal hollow body provided with a ceramic lining layer formed by the above method.

It is a conventional practice that various kinds of pipes and vessels of metals used for transportation of fluids or handling of chemical substances in carrying out chemical reactions are provided with a lining of a ceramic material in order to improve their resistance against corrosion, abrasion and heat.

There have been proposed several methods for providing such a ceramic lining to a hollow body of a metal including coating methods and binding methods. In the coating method, the inward surface of the hollow body is coated with a ceramic material followed, if necessary, by baking. In the binding method, on the other hand, another hollow body of a ceramic material is shaped in advance with somewhat smaller dimensions than the metal hollow body and the ceramic body is inserted into the metal body followed by filling the narrow interstices therebetween with a melt of a low-melting metal.

The former coating method is limited in the thickness of the ceramic lining layer so that it is not applicable when a ceramic lining of relatively large thickness is desired. The latter method of insertion is defective, even if setting aside the problems caused by the multiplicity of the fabrication steps, in that the adhesion between the ceramic insert and the metal shell is not always complete. Therefore, the ceramic layer frequently comes off the metal wall by repeated thermal expansion and contraction or by a mechanical shock.

Thus, none of the prior art methods is satisfactory for providing a ceramic lining with sufficient thickness to a metal hollow body without the danger of peeling or exfoliation even by a large heat shock or mechanical shock.

SUMMARY OF THE INVENTION

It is an object of the present invention to provide a novel and improved method for forming a lining of a ceramic material on the inward surface of a hollow body of a metal, according to which the thickness of the ceramic lining layer can be as large as desired.

Another object of the present invention is to provide a simple and very convenient method for forming a ceramic lining layer on the inward surface of a metal hollow body, according to which the ceramic lining layer is formed in one step.

Further object of the invention is to provide a method for forming a ceramic lining layer on the inward surface of a metal hollow body, according to which the ceramic lining layer is safe from peeling or exfoliation even by services under severe conditions with great heat shocks or mechanical shocks.

The inventive method for forming a lining layer of a ceramic material on the inward surface of a hollow body of a metal comprises the steps of (a) placing a powdery thermit mixture composed of a strongly reductive element and a reducible metal oxide in the hollow space of the hollow body, (b) rotating the hollow body around an axis so as that the powdery thermit mixture is pressed against the inward surface of the hollow body by the centrifugal force to form a layer, (c) igniting the thermit mixture at least at one point of the layer formed on the inward surface of the hollow body while still under the centrifugal force so as that thermit reaction of the thermit mixture takes place and the reducible metal oxide is reduced to the molten metal while the strongly reductive element is oxidized to the molten oxide which forms the innermost layer of ceramic nature with the molten metal forming the intermediate layer, and (d) cooling the hollow body having, on the inward surface thereof, stratified layers of the metal formed from the reducible metal oxide and the ceramic oxide material formed from the strongly reductive element.

DETAILED DESCRIPTION OF THE PREFERRED EMBODIMENTS

Figure 1:
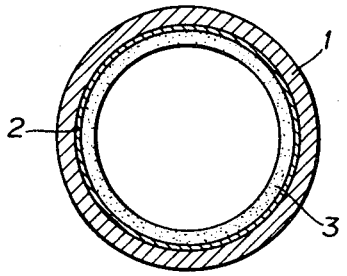
FIG. 1 is a schematic illustration of a radial cross section of a cylindrical hollow body provided with a ceramic lining layer in accordance with the inventive method.

The above described method of the invention is applicable to any hollow body of a desired shape and is most successfully applied to pipes and other cylindrical bodies. The material of this hollow body is a metal which is resistant to the heat which may reach the walls of the hollow body during the thermit reaction. In this regard, the wall thickness of the metal hollow body is desirably at least 1 millimeter or, preferably, at least a few millimeters since otherwise the wall may be melted down by the heat in the thermit reaction. Suitable metals for the hollow body include iron, nickel and chromium as well as alloys of these metals such as stainless steels and the like though not limited thereto. It is further required that the hollow body has a sufficiently high mechanical strength not to be destroyed by the centrifugal force which the hollow body receives during the thermit reaction.

Needless to say, a thermit mixture is a powdery mixture composed of a strongly reductive element capable of reducing other oxide materials and a reducible metal oxide which is readily reduced to metallic. Any combinations of the strongly reductive element and the reducible metal oxide conventionally used in the thermit reactions may be used in the inventive method according to the particular need of providing the ceramic lining. In particular, the strongly reductive element is selected from the group consisting of aluminum, magnesium and silicon, among which aluminum having an ignition temperature of about 1200° C. is the most preferred owing to the easiness in controlling the thermit reaction. On the other hand, the thermit reaction with magnesium alone as the strongly reductive element is too violent and hence is less preferred while the ignition temperature of the thermit reaction with silicon alone as the strongly reductive element is too high. However, the use of these elements in combination is sometimes advantageous in providing a means for controlling the ignition temperature or in giving a more dense structure of the ceramic layer by the effect of decreasing the melting temperature of the aluminum oxide. At any rate, magnesium and silicon are also very promising with the excellent properties inherent to them depending on the development of suitable techniques for practicing the thermit reaction therewith.

On the other hand, the reducible metal oxide is selected from the group consisting of the oxides of iron, chromium, nickel, titanium, vanadium, zinc, copper and manganese, all belonging to the 4th period of the Periodic Table. The heat of reaction produced in the thermit reaction widely differs depending on the combination of the strongly reductive element and the reducible metal oxide. Several data of the $-\Delta H$ values in kilojoules per mole of the strongly reductive element are summarized in Table 1 below.

TABLE 1

(kilojoules)

| Reducible metal oxide | Strongly reductive element | | |
|---|---|---|---|
| | Al | Mg | Si |
| $Fe_2O_3$ | 418 | 323 | 311 |
| $Fe_3O_4$ | 408 | 316 | 298 |
| $Cr_2O_3$ | 265 | 221 | — |
| NiO | 464 | 353 | 373 |
| $MnO_2$ | 439 | 337 | 339 |

These components of the thermit mixture are used in powders of as fine as possible particle size distribution but a particle size to pass a 50 mesh screen is sufficient in most cases. The blending ratio of these two components in the thermit mixture is basically in stoichiometric amounts but the mixture may contain one of the components in excess over stoichiometry, if desired. In addition, the thermit mixture may contain other components not pertaining to the thermit reaction such as oxides, carbides and nitrides. These third components serve to give an increment to the thickness of the resultant ceramic layer or may function as a flux material to decrease the melting point of the product of the thermit reaction facilitating the formation of the ceramic layer. For example, addition of an alkali metal oxide, e.g. potassium oxide, is effective in facilitating formation of a glassy smooth surface of the ceramic layer and recommendable when a decreased resistance against fluid flow is desired as in the pipes for transportation of slurries. At any rate, it is desirable that at least 50% by weight of the thermit mixture is composed of the stoichiometric mixture of the strongly reductive element and the reducible metal oxide in order to ensure sufficient temperature elevation by the thermit reaction.

The thermit mixture prepared by uniformly blending the above described components is then placed in the hollow space of the hollow body. The manner in which the mixture is placed therein is somewhat different according to several parameters such as the shape of the hollow space, the amount of the thermit mixture which is determinant of the thickness of the ceramic lining layer and the like. When a hollow body of a relatively small inner diameter is desired to be provided with a relatively thick ceramic lining layer, for example, the hollow space is loosely filled with the thermit mixture. On the other hand, when the desired ceramic lining layer has a relatively small thickness, the thermit mixture is pressed to the inward surface of the hollow body by a suitable means so as to form a layer of the compacted powdery mixture with a thickness as even as possible adhering to the surface. If desired, a binder material may be used as blended with the powdery mixture in this case.

The next step is the rotation of the hollow body thus filled or coated with the thermit mixture at a high speed. This rotation is readily performed by mounting the hollow body on a centrifuge machine. It is of course advantageous that, when the hollow body has an axial symmetry in itself such as a circular tube or a cylindrical vessel, the axis of this rotation coincides with the axis of symmetry of the hollow body per se. The velocity of this rotation should be as high as possible so as that the thermit mixture inside the hollow body receives a centrifugal force of at least 50 G or, preferably, from 100 to 200 G. By this rotation, the thermit mixture inside the hollow body is further pressed against the inward surface of the hollow body and compacted to form a dense layer of the powdery mixture.

In the next place, the thermit reaction is induced in the thermit mixture by bringing at least a part of the thermit mixture to or above the ignition temperature of the mixture, e.g. 1000° C. or higher. This ignition may be carried out, for example, by contacting a flame of an acetylene torch with the thermit mixture which is still rapidly rotating in the hollow body mounted on the centrifuge machine. The thermit reaction thus initiated at a point of the thermit mixture rapidly propagates to the whole body of the mixture and the reaction is completed almost instantaneously whereby the temperature of the layer of the thermit mixture reaches 3000° C. or higher. Being molten at this high temperature under the influence of the centrifugal force, the oxide of the strongly reductive element, e.g. $Al_2O_3$, and the metal formed from the reducible metal oxide, e.g. iron, are pressed against the inward surface of the hollow body in stratification with the oxide forming the innermost layer and the metal forming the intermediate layer by virtue of the large difference in the densities of them. Strong bonding is obtained not only between the walls of the hollow body and the thus formed intermediate metal layer but also between the innermost ceramic oxide layer and the intermediate metal layer. It is a desirable condition that the temperature of the thermit mixture is kept at 2000° C. or higher for at least a few seconds so as that the separation of the molten metal from the ceramic material formed in situ is more complete and the bonding strength between the newly formed metal layer and the base wall of the hollow body or the ceramic layer is increased. The gases unavoidably contained in the powdery thermit mixture are usually removed during this step but it may be sometimes advantageous in the case where the thickness of the newly formed layer is large to provide a means for evacuation such as a vacuum pump to accelerate degassing.

As is understood from the above description, a ceramic lining layer of densified structure is formed on the inward surface of the hollow body with an intervening layer of the metal. The thickness of the ceramic lining layer can be very uniform and controlled by using suitable amounts of the thermit mixture placed in the hollow space of the hollow body. Furthermore, the ratio in thickness of the ceramic lining layer and the intervening metal layer can also be controlled by using non-stoichiometric thermit mixture or by the addition of a third component.

FIG. 1 is a schematic illustration of a radial cross section of a cylindrical hollow body 1 provided with a ceramic lining layer 3 bonded to the wall of the hollow body 1 through an intervening metal layer 2 formed by the thermit reaction in accordance with the method of the present invention.

In the following, the method of the present invention is described in further detail by way of examples.

EXAMPLE 1

A thermit mixture was prepared by intimately blending 78 g of metallic aluminum powder and 250 g of iron oxide $Fe_3O_4$ having particle size distributions to pass a 200 mesh and a 50 mesh screen, respectively, after being thoroughly dried by heating at 120° C. for 24 hours. The blending ratio was approximately stoichiometric. A carbon steel pipe of inner diameter 70 mm and wall thickness 3 mm as cut in a length of 100 mm was mounted on a centrifuge machine and loosely filled with the above prepared thermit mixture.

After a short while from the moment when the rotation of the centrifuge machine had reached a velocity of about 2000 r.p.m., at which the layer of the thermit mixture received a centrifugal force of about 150 G, the thermit mixture was ignited by contacting at an end thereof with a flame of an acetylene torch. The thermit reaction was completed instantaneously and, after completion of the reaction, rotation of the centrifuge machine was continued for further 10 minutes to cool down the body.

The thus obtained pipe had a radial cross section similar to that shown in FIG. 1 having an innermost ceramic lining layer of alumina with a uniform thickness of about 2 mm bonded to the body of the pipe through an intermediate layer of metallic iron having a dendritic or columnar structure with interlacing with the grain structure of the outer and inner layers at the boundaries indicating strong mechanical bonding between the layers.

Figure 2:
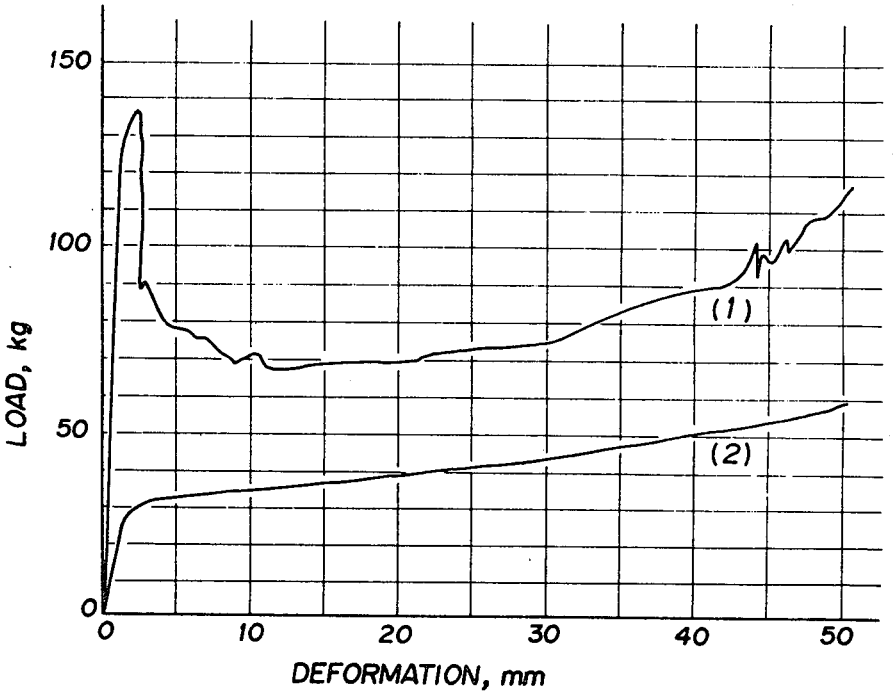
FIG. 2 illustrates stress-strain curves obtained in the squeezing test of a steel pipe provided with a ceramic lining according to the inventive method and of the same pipe without lining.

The steel pipe thus provided with the ceramic lining layer was cut in a radial plane into a ring-wise piece of 5.4 mm width and this ring-wise test piece was subjected to a squeezing test by compressing in the radial direction. The relationship between the load in kg and the deformation of the ring in mm was shown by the curve (1) in FIG. 2. The ceramic layer became destroyed at the peak of the curve. In parallel, the same carbon steel pipe without the ceramic lining layer was subjected to the same squeezing test to give the result shown by the curve (2) in FIG. 2.

The ceramic-lined pipe obtained above was cut open and the averaged apparent density of the newly formed layers and the hardness $H_v$ of the ceramic layer were determined. In parallel, similar ceramic-lined pipes were prepared in the same conditions as above except that the velocity of centrifugal rotation was decreased to 1000 r.p.m. or 100 r.p.m. giving a centrifugal force of about 40 G or 0.4 G, respectively, to the layer of the thermit mixture. The averaged apparent densities of the newly formed layers and the values of the hardness of the ceramic layers in these pipes were also determined. The results are shown in Table 2 below. As is understood from this table, a centrifugal force of at least 50 G is desirable in order to obtain highest density of the lining layer and the highest hardness of the ceramic layer.

TABLE 2

| Rotation r.p.m. | Centrifugal force, G | Apparent density, g/cm$^3$ | Hardness, $H_v$ |
|---|---|---|---|
| 100 | 0.4 | 3.2 | 1000 |
| 1000 | 40 | 4.0 | 1400–1700 |
| 2000 | 150 | 4.3 | 1400–1700 |

EXAMPLE 2

A thermit mixture was prepared by intimately blending 65 g of metallic aluminum powder, 200 g of iron oxide $Fe_3O_4$ and 100 g of aluminum oxide after being thoroughly dried by heating at 120° C. for 24 hours. This powdery mixture was pressed to the inward surface of a carbon steel pipe having the same dimensions as in the preceding example and mounted on a centrifuge machine so as that a layer of the powdery mixture having a uniform thickness of about 15 mm was formed on the pipe wall. While the pipe was being rotated at such a velocity that the layer of the thermit mixture received a centrifugal force of about 180 G, the thermit mixture was ignited in the same manner as in the preceding example to effect the thermit reaction. After completion of the reaction, the pipe was rotated for further 10 minutes.

In this manner, the steel pipe was provided with a ceramic lining layer of alumina having a uniform thickness of about 3 mm and a dense structure as bonded to the pipe wall through an intermediate layer of iron formed by the thermit reaction.

What is claimed is:

1. A method for providing a ceramic lining of layer on the inner surface of a hollow metal body which comprises the steps of (a) placing a powdery thermit mixture comprising a strongly reductive element and a reducible metal oxide in the hollow space of the hollow body, (b) rotating the hollow body around an axis so that the powdery thermit mixture is pressed against the inner surface of the hollow body by centrifugal force to form a layer, (c) igniting the thermit mixture at least at one point of the layer thereof formed on the inner surface of the hollow body while still under the centrifugal force so that the thermit reaction of the thermit mixture takes place and the reducible metal oxide is reduced to a molten metal and the strongly reductive element is oxidized to an oxide which forms an innermost layer of ceramic material with the molten metal forming an intermediate layer between the inner surface of the hollow body and the innermost layer, (d) degassing the space within the hollow body by means of a vacuum to remove thermit reaction gasses and to remove gasses from the layers, and (e) then cooling the hollow body to solidify said intermediate and innermost layers and provide on the inner surface of the hollow body, stratified layers of the metal and the ceramic material.

2. The method as claimed in claim 1 wherein the strongly reductive element is selected from the group consisting of aluminum, magnesium and silicon.

3. The method as claimed in claim 1 wherein the strongly reductive element is aluminum.

4. The method as claimed in claim 1 wherein the reducible metal oxide is selected from the group consisting of the oxides of iron, chromium, nickel, titanium, vanadium, zinc, copper and manganese.

5. The method as claimed in claim 1 wherein the reducible metal oxide is an oxide of iron.

6. The method as claimed in claim 1 wherein the thermit mixture is a stoichiometric mixture of the strongly reductive element and the reducible metal oxide.

7. The method as claimed in claim 1 wherein the thermit mixture is a non-stoichiometric mixture of the strongly reductive element and the reducible metal oxide.

8. The method as claimed in claim 7 wherein the thermit mixture contains at least 50% by weight of the stoichiometric mixture of the strongly reductive element and the reducible metal oxide.

9. The method as claimed in claim 1 wherein the hollow body is rotated around an axis at such a velocity that the thermit mixture placed in the hollow space of the hollow body receives a centrifugal force of at least 50 G.

10. The method as claimed in claim 9 wherein the centrifugal force is in the range from 100 to 200 G.

* * * * *